US005322980A

United States Patent [19]

Benda

[11] Patent Number: 5,322,980

[45] Date of Patent: Jun. 21, 1994

[54] CIRCUIT BREAKER LOCK OUT-MULTI-POLE

[76] Inventor: Steven J. Benda, P.O. Box 782, Cokato, Minn. 55342

[21] Appl. No.: 813,341

[22] Filed: Dec. 24, 1991

[51] Int. Cl.[5] ..... H01H 9/28

[52] U.S. Cl. ..... 200/43.014; 200/43.11; 200/43.19

[58] Field of Search ..... 200/43.01, 43.11, 43.12, 200/43.13, 43.14, 43.15, 43.16, 43.17, 43.18, 43.19, 43.21, 43.22, 333, 334, 50 R, 50 A, 50 AA, 50 C; 70/DIG. 30, 163, 164, 174

[56] References Cited

U.S. PATENT DOCUMENTS

| | | | |
|---|---|---|---|
| 2,703,827 | 3/1955 | Gelzheiser | 200/50 C |
| 3,213,326 | 10/1965 | Gryctko | 200/50 C |
| 3,255,320 | 6/1966 | Norden | 200/43.15 |
| 3,426,164 | 2/1969 | Dessert | 200/43.15 |
| 3,470,336 | 9/1969 | De Angelo | 200/43.15 |
| 3,705,280 | 12/1972 | Harms | 200/50 C |
| 4,006,324 | 2/1977 | Leasher et al. | 200/43.15 |
| 4,347,412 | 8/1982 | Mihara et al. | 200/43.15 |
| 4,467,152 | 8/1984 | Gordy | 200/43.15 X |
| 4,677,261 | 6/1987 | Nourry | 200/43.15 |
| 4,980,525 | 12/1990 | Kakisako | 200/50 C X |
| 5,079,390 | 1/1992 | Costanzo et al. | 200/43.4 |
| 5,109,142 | 4/1992 | von Kannewurff et al. | 200/50 C X |

FOREIGN PATENT DOCUMENTS

| | | | |
|---|---|---|---|
| 554049 | 3/1958 | Canada | 200/43.21 |
| 3236023 | 3/1984 | Fed. Rep. of Germany | 200/43.22 |

*Primary Examiner*—Henry J. Recla
*Assistant Examiner*—Glenn T. Barrett
*Attorney, Agent, or Firm*—Paul H. Gallagher

[57] ABSTRACT

A single, molded one-piece member, having a bottom recess for receiving the levers of a plurality of switches, on which a tie bar is mounted. The member is flexed to spread the walls of the recess, and when it is released, a locking lug moves under the tie bar, holding the lock out in place. A tie wrap is placed under the tie bar and around the adjacent elements of the member locking the member in place. A first form has two such recesses, of different sizes. An alternate form has a single recess, and a cover which is closed down over the base, enclosing the tie wrap. An auxiliary lock can be used for locking the cover. A supplementary locking element may be selectively placed in the recess for accommodating switch levers of different sizes. Another form includes a thumb screw adjustment means for positively holding the locking lug under the tie bar.

18 Claims, 3 Drawing Sheets

BOTTOM

TOP

CIRCUIT BREAKER LOCK OUT- MULTI-POLE

CROSS REFERENCE

My prior and copending parent application Ser. No. 07/644,554, filed Jan. 23, 1991; now Pat. No. 5,122,624, dated Jun. 16, 1992.

BRIEF SUMMARY OF THE INVENTION

The invention resides in the field of controlling circuit breakers in an electrical system as set out in my parent application (no. 07/664,554, identified hereinabove). As set out in that application, it is desired to block out certain circuit breakers to de-energize corresponding circuits, when work is to be done in or around the circuits. The invention of the parent application has to do generally with this problem, and more specifically for blocking out a single circuit breaker. The present invention is directed to the same 15 general purposes, but more specifically to a multi-pole block out, for blocking out a plurality of circuit breakers, and de-energizing-the corresponding circuits associated with those circuit breakers.

Circuit breakers are often referred to as switches, and will be so referred to at times herein.

The devices of the present invention serve the purpose of blocking out the circuit breakers or switches, and additionally perform a locking function, and may be referred to as lockout devices.

A main object of the invention is to provide lockout devices of the foregoing character having the following features and advantages, certain ones of which are also set out in the parent application:

1. It is extremely simple, being of one-piece construction, of molded material (plastic), and capable of being made in great quantities rapidly.
2. It can easily be applied to the switch by a workman, simply and quickly, manually and without tools.
3. Each device disclosed in the invention includes a separate and main member, or body, that can be applied to the switch in the desired position of the switch (open or OFF), and without the requirement of extraneous elements, although extraneous elements may be utilized when desired. In certain instances, a supplemental element may be utilized for adapting the device to switches of different sizes.
4. Each device includes a self-contained locking element for locking to the switches.

DETAILED DESCRIPTION

Figure 1:
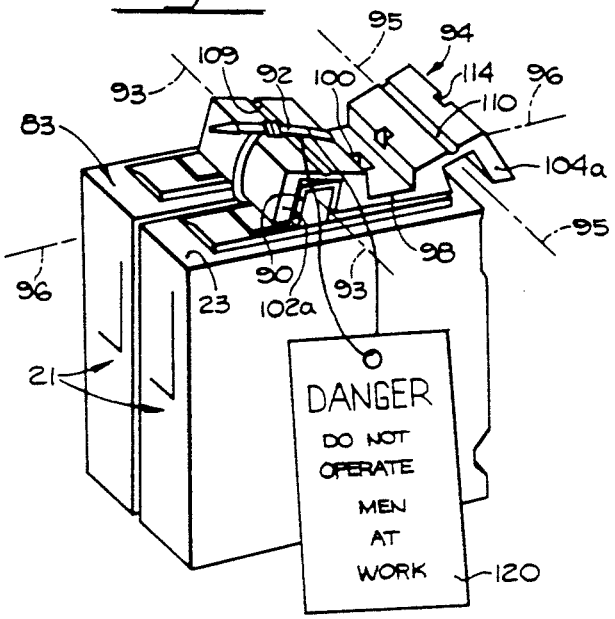
FIG. 1 is a perspective view of one form of lockout, applied to a plurality of switches.
Figure 2:
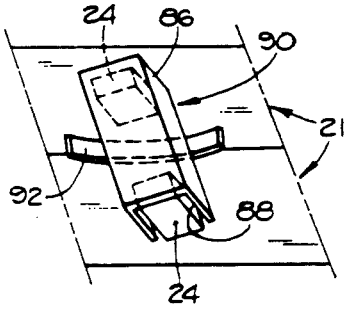
FIG. 2 is fragmentary perspective view of a portion of the switches under the lockout, of FIG. 1.

Reference is first made to the form of the device illustrated in FIGS. 1–5. In many instances, where switches are arranged in groups, it is desired that when one portion of the circuit controlled by one switch, is out of commission, associated switches be opened or disabled. In such instances a tie bar, or clamp-on bar 20 is utilized. FIG. 2 shows two switches 21 having front panels 23 actuating levers or tongues 24 extending through the front panels, and such a tie bar 86 of known kind. This tie bar is shown somewhat diagrammatically, and basically is in the form of an inverted channel 88 fitted over the actuating levers of the several switches involved, and is held or locked thereon in a known manner not pertinent in the present instance. The tie bar when so utilized is spaced from the front panel of the switches, and it thereby provides an opening 90 which is utilized as a locking hole between itself and the switches. This hole receives a tie wrap 92 in the form of a strap, referred to hereinbelow.

The switches 21 when positioned together as in FIG. 1, are considered as aligned along an axis 93, for convenience in identification and orientation.

Figure 3:
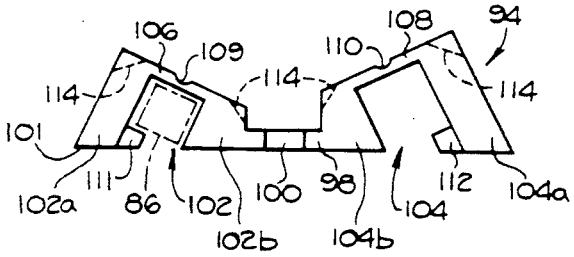
FIG. 3 is a side view of the lockout of FIG. 1.
Figure 5:
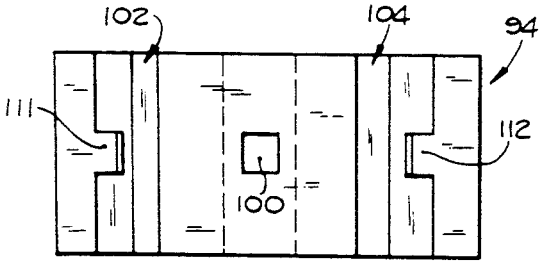
FIG. 5 is a bottom view of the lockout of FIG. 1.
Figure 4:
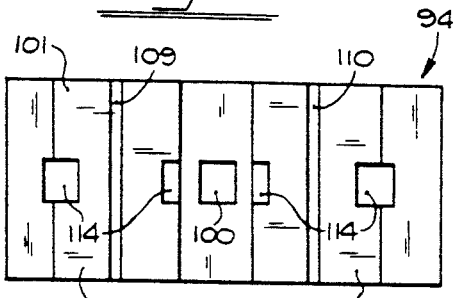
FIG. 4 is a top view of the lockout of FIG. 1.

The lockout of this form (FIGS. 1–5) indicated in its entirety at 94, is a single, molded, one-piece member, which may also be referred to as a body, for convenience, and is separate from and independent of the switches themselves. This lockout has a length direction along the axis 95, parallel with the axis 93, so referred to for convenience, in associating it with the linear alignment of the switches along the axis 93, and a width direction along the axis 96. It is of a length appropriate to extend over the number of switches affected, in this case two. Additionally, for convenience, the device is described as oriented as shown in FIGS. 1 and 3 but it of course may be oriented in other positions, and in the latter case, the description thereof will be interpreted accordingly. As so oriented, in FIGS. 1 and 3, it includes a center element 98 at the bottom which is relatively thin and correspondingly flexible. It also has a center aperture 100 in the element 98. The body has a bottom surface 101.

The device includes spaced apart recesses 102, 104 in the form of channels, which extend through the device in the direction of the axis 95 thus having open ends, these recesses being angled upwardly and toward each other (FIG. 3). These angular recesses are of different widths to accommodate actuating levers of different dimensions. These recesses are defined at their upper and closed ends by relatively thin top elements 106, 108 which are flexible, and formed in the outer or top surfaces of these elements are grooves 109, 110 which extend the full length of these elements, i.e., the full length of the recesses, and which provide greater flexibility at their locations as referred to again hereinbelow. The recess 102 is defined at its sides by an outer element 102*a* and an inner element 102*b*, and similarly, the recess 104 is designed at its sides by an outer element 104*a* and an inner element 104*b*.

The recesses 102, 104 open downwardly, and adjacent these bottom open sides, the corresponding elements 102*a* and 104*a* have locking lugs 111, 112 extending into the respective recesses. The lockout 94 also is provided with indentations 114 at various external locations for receiving the tie wrap 92 (FIGS. 1, 2).

The lockout of this form is applied to the switches by putting the bottom surface 101 directly against the faces of the switches, and fitting it over the tie bar 86, and it would then be over the actuating levers of the switches also, in the one recess selected, according to the dimension involved: in the illustrations, it is the left hand one of FIGS. 1, 3. To so apply the device to the switches, the user flexes the member by gripping the element 102*a* and pulling it outwardly, which thereby bends the top thin portion 106, at the designed hinge line 109, this bending being in such direction as to form a concave surface on the member on the top. This withdraws the locking lug 111, and enables the lockout to be fitted as referred to, and then the element 102*a* is released and that element resumes its normal position, and thereby the locking lug 111 moves into the hole 90 (FIG. 2), locking the lockout on the ganged switch assembly. It will be recalled, as referred to hereinabove, the tie bar 86 is secured to the switch levers 24 securely, in a step not associated with the present invention.

The lockout has a normal straight or flat position as represented in FIG. 3, and after it is applied as just referred to, it assumes that position, and the bottom surface 101 fits on the front panel 83, which is made up of the front panels of the individual switches, throughout its own length. After the lockout is so applied, the tie 92 is applied, by inserting an end through the center aperture 100, then through the hole 90 under the tie bar, and the ends are brought around and over the top of the corresponding portion of the lockout and interconnected (FIG. 1), fitting in the indentations 114. The tie wrap pulls and squeezes the elements together, and against the tie bar, locking the device firmly in place.

Referring again to the thin portions 106, 108, it sometimes occurs that convenient space does not exist for accommodating the complete lockout, and in that case the excess portion according to the position of the applied lockout, e.g., the right hand end (FIG. 3), can be swung upwardly about the groove 110 which readily accommodates that movement to an upper position, this end of the lockout in that condition then not functioning. It may then be desired even to cut out the extended end portion and that may be done easily by cutting along the groove.

The tie wrap 92 provides a convenient means for hanging a tag 120 which contains a notice or warning.

The tie wrap 92 locks the lockout securely to the switches to provide the desired security according to prevailing practices and regulations. FIG. 3 indicates this relationship to good effect, showing the elements 102*a*, 102*b* in surrounding relation to the tie bar 86. In using the other recess, 104, the other elements 104*a*, 104*b*, perform the same function.

The recesses 102, 104, as noted above, are open ended, i.e., without end walls, enabling the outward flexing of elements 102*a*, 104*a* referred to.

Figure 6:
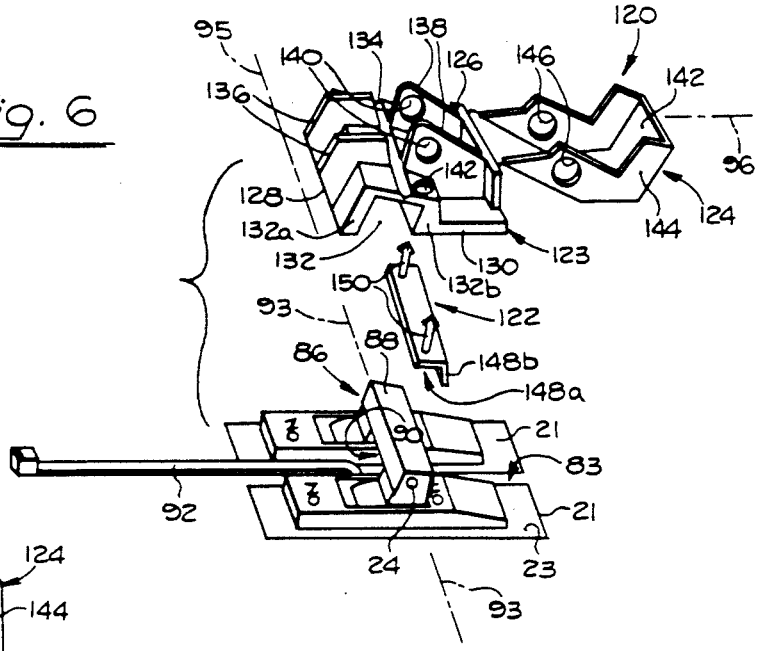
FIG. 6 is an exploded, perspective view of another form of lockout, together with a portion of the switches, and an auxiliary element.

Reference is now made to another form of device illustrated in FIGS. 6–12. FIG. 6 shows a second form of lockout, indicated as a whole at 120, a supplemental locking element 122, and an assembly of switches 21. The assembly of switches includes the axis 93 on which the switches are aligned. FIG. 6 also shows the axis 95, included in FIG. 1, for orienting the device.

The lockout 120 of this form also is a single, molded, one-piece member or body, separate from and independent of the switches themselves.

The lockout 120 includes as two main parts, a base 123 and a cover 124. The body has a center element 126 that is relatively thin and provides a hinge means for easy swinging of the cover into an outer closed position on the base. This hinge is parallel with the length dimension axis 95.

Figure 9:
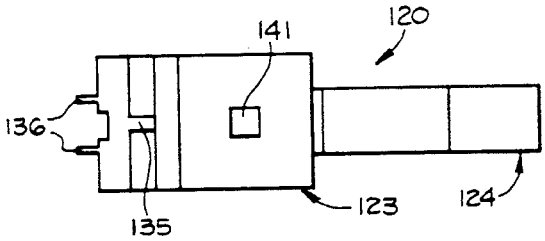
FIG. 9 is a bottom view of the lockout at FIG. 6–8.
Figure 11:
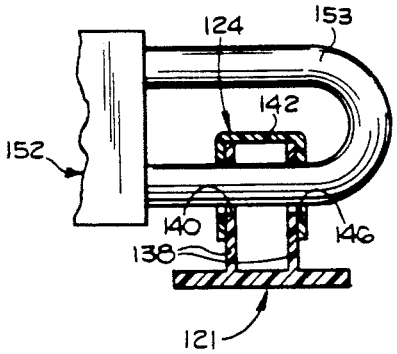
FIG. 11 is a sectional view taken at line 11—11 of FIG. 8.
Figure 10:
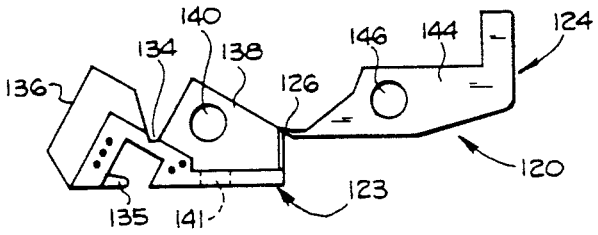
FIG. 10 is a side view of the lockout.

The device of FIG. 6 is referred to as having a front end 128, for convenience, and a bottom surface 130. The base 123 has a recess 132 in its under surface opening downwardly through the bottom surface, and open at the ends along the direction of the axis 95. The recess 132 is defined at its sides by elements 132*a* and 132*b*, and the base on the top is provided with a groove 134 for facilitating bending of the article as referred to below. The element 132*a* has a locking lug 135 at the bottom, extending into the recess (FIGS. 9, 10).

The base has upwardly extending spaced ribs, or walls 136 at the front end for strengthening purposes, and for blocking against intrusion as referred to again hereinbelow. It also includes other spaced walls 138 having locking holes 140 therein, these walls also serving as strengthening elements. The element 132*b* additionally is provided with a pair of holes 142 on vertical axes, and opening through into the recess. These are used for locking the supplementary locking element 122 in place as referred to below.

The cover 124 is shaped primarily to enclose certain elements on the base, and includes an enclosing wall 142, made up of three segments or sections (see FIG. 8) appropriately positioned and shaped for covering the elements on the base. The cover also has side walls or flanges 144, the latter having transverse locking holes 146.

Figure 7:
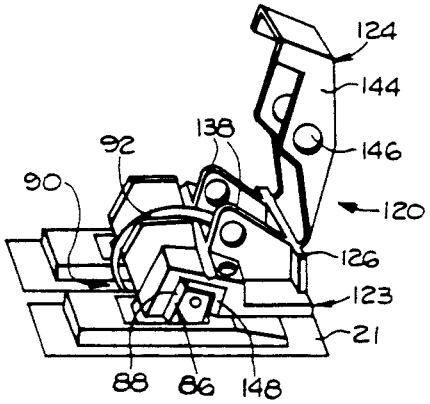
FIG. 7 is a perspective view of the lockout of FIG. 6 in an intermediate step of applying it to a switch.
Figure 8:
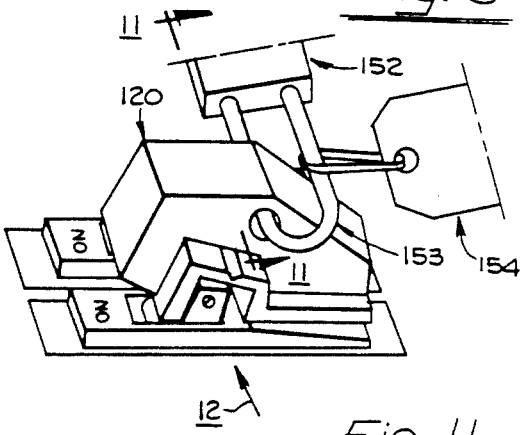
FIG. 8 is a perspective view oriented according to FIG. 7, but with the cover element closed.

FIG. 6 shows the cover in open position, and it is swingable about the hinge 126 in counterclockwise direction into a closed position shown in Fig- 8. FIG. 7 shows the cover in an intermediate position, in the step of closing it.

The supplemental locking element 122 will be referred to again hereinbelow, in an alternate arrangement of the lockout, but it is pointed out that it is in the form of an angle, having flanges 148 individually identified 148*a*, 148*b*, and locking pins 150 which penetrate through the locking holes 142 in the lockout itself, 120.

To apply the lockout to the switch assembly, the base 123 is fitted in position over the switch assembly, in the manner described above, and as indicated in FIGS. 7, 8. This is done with the cover 124 in the open position, and in such position, the tie wrap 92 is put in place, by inserting an end thereof through the hole 90, and bringing its ends around the tie bar 86, and through the aperture 141 (FIG. 9) and over the front portion of the base, i.e., over the elements 132*a* , 132, and then tied. This step is similar to the corresponding one described above in connection with the form of FIGS. 1-5. Thereafter the cover 124 is swung down over the base. The dimensions and positions of the elements are such that the flanges 144 are positioned outwardly of the walls 138, 136, and in this closed position of the cover, the locking holes 146 are in alignment with the holes 140, and additional locking security may be provided by the use of a lock, such as a padlock 152, inserting the locking element 153 thereof through those holes. The element 153 will also serve to tie a tag 154 thereon, which may be provided with a warning or other message.

In so applying the device, i.e., the base 123, to the switch as referred to, the element 132*a* is flexed outwardly, as described in connection with the first embodiment, which pulls the locking lug 135 outwardly, and enables it to move over or past the tie bar 86. When the device is then fully fitted to the switch, the element 132*a* is released, and it flexes back to its original position, and the locking lug moves into the hole 90 under the tie bar, which locks the device on the switches.

Figure 13:
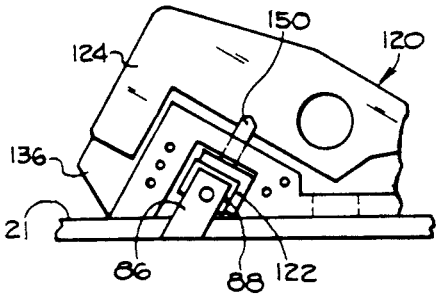
FIG. 13 is a view similar to FIG. 12 but incorporating the supplementary locking element of FIG. 6.
Figure 12:
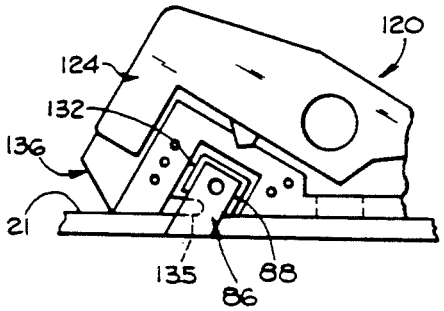
FIG. 12 is a side view in the direction of the arrow 12 of FIG. 8.

In the foregoing described use and functioning of the device, the supplemental locking element 132 may be not used, such as in the case where the switch levers 24 and tie bar substantially or nearly fill the recess. However, all switches are not uniform as to size, and certain ones may have smaller levers 24, but in that case in the use of the present invention, a single size lockout 120 may be used for different size switch levers, with the use of the supplemental locking element 122. In this case, i.e., where a small switch lever is involved, the locking element 122 is fitted on tie bar, or positioned in the recess, selectively, as shown in FIG. 13, and then the lockout fitted onto the switch, over the locking element 122, and the pins 150 penetrate through the locking holes 142, as indicated above. The locking element 122 nearly or substantially fills the recess, or at least it occupies such a portion thereof as to produce a binding effect between the walls of the recess and the switch levers (i.e., with the tie bar thereon).

The binding effect in conjunction with the switch levers is a very important feature. The design and shape of the entire lockout is such that when it bears on the switch assembly, it cannot be slid transversely, i.e., along the axis 96, because of the binding effect referred to. This binding effect is produced in all cases of different sizes and dimensions and incorporation of supplemental elements, as will be referred to again hereinbelow.

Figure 14:
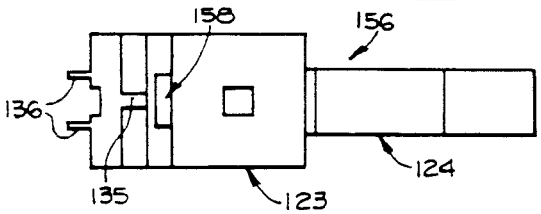
FIG. 14 is a bottom view of an alternate form of the device.
Figure 16:
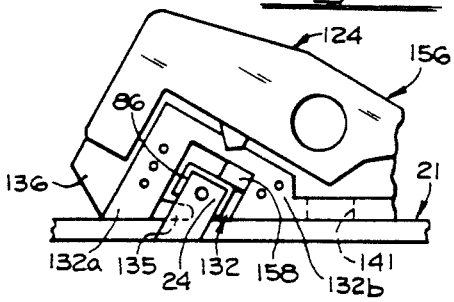
FIG. 16 is a side view showing the device of FIG. 15 applied to a switch.
Figure 15:
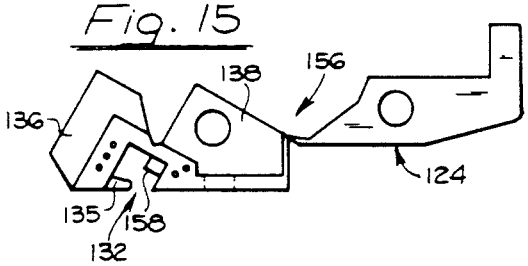
FIG. 15 is a side view of the device of FIG. 14.

As an alternate construction, incorporating the different form of binding element, the construction illustrated in FIGS. 14-16 may be provided. In this case the device, now identified at 156 is identical with that of FIG. 6 with the addition of element 158. This element may be in the form of a projection. It extends a short distance into the recess as shown in these figures, and when the device is fitted on the switch, this element engages the tie bar (FIG. 16) and produces the effect of filling the recess or reducing the effective space therein. This element by engaging the bar, produces the same binding effect referred to, preventing transverse movement of the lockout, along the axis 96. In the use of this construction, the supplementary element 122 would not be used.

Figure 17:
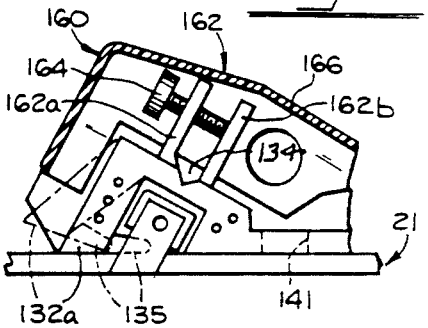
FIG. 17 is a side view similar to FIG. 12 but showing an alternate form; and with the cover partially broken away.
Figure 18:
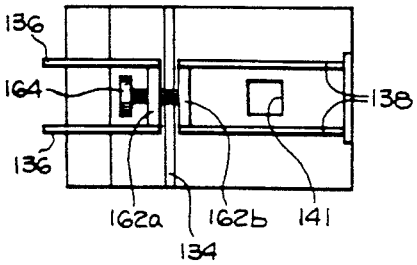
FIG. 18 is a top view of FIG. 17.

FIGS. 17 and 18 show a lockout 160 identical with the lockout 120 but with the following feature, namely, lugs or walls 162 individually identified 162*a* and 162*b* are provided on the upper wall of the base, above the recess, and on opposite side of the hinge 134. A thumb screw 164 is threaded through one of the lugs, e.g., 162*a*, and engages the other lug. In the use of this device, the thumb screw is backed off, enabling the element 132*a* to be pulled out, retracting the locking lug 135, out of its locking position under the tie bar. Upon release of the element 132*a*, it resumes its normal position, moving the locking lug 135 under the tie bar, and then the thumb screw 164 is screwed up tight against the lug 162*b*, locking the element 132*a* in position and consequently holding the locking lug 135 under the tie bar. The lugs and thumb screw provide a positive mechanical action in forcing the elements 132*a*, 132*b* in locking direction.

The cover 166 of the locking device 160 (FIGS. 17, 18) is dimensioned and shaped so as to cover the corresponding elements, including the lugs 162 and thumb screw 164.

Figure 19:
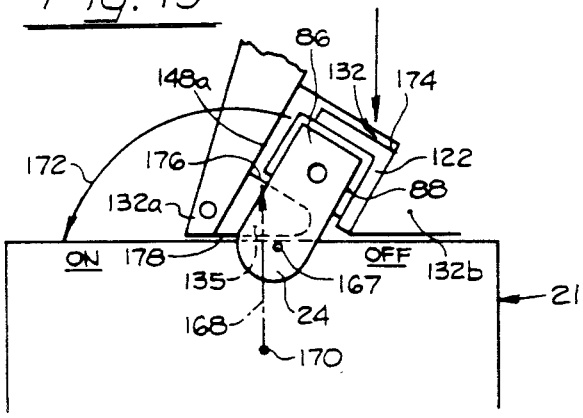
FIG. 19 is a diagrammatic view of certain elements of the switch, showing the points where forces are applied in the locking function.

Attention is directed to FIG. 19 showing the locations of forces in the binding effect between the lockout and the switches. This figure is diagrammatic in nature, including the switch 21 and lever 24 therein. The lever 24 is swingable about the axis 167, and a radius 168 is shown on an axis 170 defining an arc 172. FIG. 19 shows the switch lever in OFF position, a position also shown in FIGS. 1 and 8, where the lever is angled upwardly and to the right. In this position, engagement is established in the region of the point 174 between the corner of the lever and the wall of the recess. Another point of effective engagement is 176 where the locking lug 135 engages under the bar 88 flange 148*a* of the locking element 122. In addition to the engagement at point 176, engagement is established at 178 between the locking lug and body of the switch 21. These different points of engagement produce an extraordinary binding effect between the lockout and the switch lever. Any movement, or tendency to movement, of the switch lever when it is locked open, would be in counter-clockwise direction (FIG. 19) and in order for the switch lever to swing in that direction, it would be necessary for the lockout to move longitudinally along the surface of the switch body, but because of the binding effect at the points noted, it would be impossible for the lockout to so move. In any swinging movement of the lever, there is a necessary component in vertical direction, but because of the locking effect, or absolute blocking effect, at point 176, it would not be possible for the lockout to move in vertical direction, and therefore the switch lever is positively locked.

I claim:

1. A lock out for use with a plurality of ganged switches having indivdual front panels which form a common main front panel, each of said switches having an actuating lever wherein said actuators positioned along a common longitudinal line, and rotatable between spaced apart positions about an axis adjacent to and parallel with said longitudinal line, and a tie bar secured to the levers for producing conjoint swinging movement of the levers about said axis, said lock out comprising:

a one piece member having a bottom surface with a recess therein, the recess having first and second opposing side walls, the member being adapted to be fitted to the plurality of ganged switches in locking position such that said bottom surface is adapted to engage said main front panel and the actuating levers and the tie bar are adapted to enter into the recess;

means for locking the member to the tie bar, wherein the opposing side walls of the recess being adapted to engage levers and tie bar, preventing movement of the member in direction extending between the spaced positions of the levers, the first of the opposing side walls having a locking lug located adjacent the bottom surface of the member and extending into the recess, toward the second side wall, said locking lug being adapted to extend between the actuating levers of adjacent ganged switches and said member having a flexible portion such that the side walls are capable of being flexed apart for moving the locking lug such that the member is adapted to be removably attached to the tie bar and actuating levers.

2. A lock out according to claim 1 wherein, the recess includes a top portion, the member is composed of relatively rigid material, but the top portion of the recess forming said flexible portion, wherein the top portion is relatively thin, thereby facilitating flexing apart of said first and second walls.

3. A lock out according to claim 2 wherein, said flexible portion includes a groove extending parallel with said longitudinal line forming thereby a hinge for facilitating flexing apart of said opposing walls.

4. A lock out according to claim 1 and including, a tie wrap adapted to be wrapped on and around the tie bar and at least a portion of the member thereby forming said locking means.

5. A lock out according to claim 4 wherein, the member is provided with indentations in an outer surface for receiving the tie wrap.

6. A lock out according to claim 1 wherein, the member includes symmetrically opposite portions, each of said portions having a said recess, the recesses being parallel to each other, and the recesses are of different sizes such that said member is adapted for accommodating switch levers of different sizes, and the recesses are angled toward each other whereby to accommodate the same angled position of the switch lever in each of opposite positions of the member.

7. A lock out according to claim 6 wherein, the member has a hole between the opposite portion for accommodating a tie wrap on either of the opposite portions.

8. A lock out according to claim 1 wherein, the member includes a base and a cover hinged together, the base having said bottom surface and recess therein, and being capable of being locked to the tie bar such that the member being locked to the tie bar, the cover being swingable to closed position over the base, and the base and cover having intercooperating elements enabling the cover to be locked to the base.

9. A lock out according to claim 8 wherein, the base and cover have vertical walls which are disposed in side-by-side relationship when the cover is said closed position, the walls have having holes therethrough which are aligned in said closed position of the cover, whereby the aligned holes are adapted to receive an operative element of a locking assembly.

10. A lock out according to claim 8 wherein, the member has a thin portion between the base and the cover forming a hinge parallel with said longitudinal line.

11. A lock out according to claim 8 wherein, the base has a flexible portion positioned above the recess forming hinge and the base has vertical walls on an upper surface defining a protected space therebetween for receiving a tie wrap.

12. A lock out according to claim 8 wherein, the base includes an element forming one wall of the recess, and said wall includes said locking lug.

13. A lock out according to claim 1 in combination with, a spacer separate from said member being insertable into the recess and being adapted to fill a space between the levers and the tie bar and the adjacent walls of the recess, such that the spacer is adapted to provide effective engagement between the levers and the tie bar and the recess.

14. A lock out according to claim 13 wherein, the base has holes in a top portion opening into the recess, and the spacer includes pins extending through those holes when the spacer is positioned within the recess.

15. A lock out according to claim 1 wherein, the member includes projections extending into the recess at a top portion of the recess, said projections being adapted to be engageable with said tie bar when the locking out is applied to the switches, and thereby effectively eliminating space between the tie bar and walls of the recess.

16. A lock out according to claim 1 wherein, the member includes lugs on a top portion of said member on opposite sides of the flexible portion, and adjustable means engaging the lugs to prevent movement of the lugs toward each other and thereby prevent said first and second walls for flexing.

17. A lock out for use with a plurality of ganged switches having individual front panels which form a common main front panel, each of said switches having an actuating lever wherein said actuators are positioned along a longitudinal line and rotatable between spaced positions about an axis adjacent to and parallel with said longitudinal line, and a tie bar secured to the levers for producing conjoint swinging movement of the levers about said axis, said lock out comprising:

a member having a broad bottom surface with a recess therein, the recess having opposing side walls, the member being adapted to be fitted to the ganged switches in a locking position thereon such that said bottom surface is adapted to engage said main panel and the actuating levers and the tie bar are adapted to extend into the recess, said bottom surface extends over a plurality of said individual front panels in direction perpendicular to said axis, and said bottom surface and individual front panels being free of any positive interlocking elements that would prevent movement of the member on the switches and the opposing side walls of the recess being adapted to engage the actuating levers and tie bar, said engagement between the side walls and the actuating levers and tie bar and an interengagement between the member and the main panel, producing a binding action between the member and the ganged switches thereby preventing swinging movement of the actuating levers, thereby locking said levers.

18. A lock out according to claim 17 wherein, the member includes a portion that has a locking lug lying adjacent to said bottom surface, said portion being movable relative to the remainder of the member to a position projecting the locking lug under the tie bar in the recess, and movable from that position for withdrawing the locking lug from under the tie bar.

* * * * *